United States Patent [19]

Gag

[11] Patent Number: 4,832,631

[45] Date of Patent: May 23, 1989

[54] SWIMMING AID

[76] Inventor: Marvin N. Gag, Mission Homes, 2429 Northridge Dr., N. Mankato, Minn. 56001

[21] Appl. No.: 185,395

[22] Filed: Apr. 25, 1988

[51] Int. Cl.[4] ..... B63H 16/04

[52] U.S. Cl. ..... 440/26; 440/98; 440/101

[58] Field of Search ..... 440/21, 26, 27, 101, 440/98, 102, 17; 114/315

[56] References Cited

U.S. PATENT DOCUMENTS

| | | | |
|---|---|---|---|
| 1,102,526 | 7/1914 | Luki | 440/26 |
| 1,777,749 | 10/1930 | Eguiluz | 440/27 |
| 2,416,471 | 2/1947 | Chappedelaine | 440/27 |
| 3,045,636 | 7/1962 | Thomas | 115/23 |
| 3,580,213 | 5/1971 | Yuen | 440/27 |
| 3,779,202 | 12/1973 | Martin et al. | 115/22.3 |
| 4,726,550 | 2/1988 | Chen et al. | 440/27 X |

*Primary Examiner*—Sherman D. Basinger
*Assistant Examiner*—Edwin L. Swinehart
*Attorney, Agent, or Firm*—Donald A. Jacobson

[57] ABSTRACT

A manually powered pair of crank operated flat paddles used by a swimmer combines a rotary and paddling motion. One paddle is rotated to engage the water while the opposite paddle is disengaged and provides flotation only. The opposite paddle is then rotated to engage the water while the first paddle is disengaged. This apparatus combines support with propulsion to assist the beginning swimmer. The motion of the swimmer's arms using this device mimics a normal swimming stroke and aids the learning process.

7 Claims, 3 Drawing Sheets

SWIMMING AID

BACKGROUND OF THE INVENTION

I. Field of the Invention

The present invention relates to a manually arm powered swimming aid device which both supports the swimmer and also supplements the usual paddling action to help the beginning swimmer learn to swim and to provide a water toy.

II. Description of the Prior Art

There are a number of known manually arm powered swimming aids which also provide support to the swimmer. U.S. Pat. No. 1,102,526 has a flotation ring to encircle a swimmer which supports a pair of opposed paddle wheels which are operated by a manual crank. U.S. Pat. No. 1,777,749 has a pair of flotation disks which carry a number of hinged paddle elements and are interconnected by a crank. The immersed swimmer rotates the disks by the paddle wheel which provides both flotation and propulsion. U.S. Pat. No. 3,580,213 is quite similar except that the flotation elements have fixed radial elements formed into the disk but the purpose and operation is quite similar. U.S. Pat. No. 3,779,202 has a pair of paddles attached to a surfboard which are crank operated by a swimmer lying on the surfboard for support. U.S. Pat. No. 3,045,636 has a flotation structure in which the operator is seated for support with two independent opposed arm operated paddle wheels for propulsion.

All of these devices rely strictly on rotation of the paddle wheels for propulsion which bears no relationship to a normal arm swimming stroke. Those that utilize the paddle wheel solely to support the swimmer in the water are large unwieldly structures which are bulky to store and transport. Further, a large amount of the energy required to rotate a paddle wheel supporting a swimmer is wasted because when the paddle wheel is largely immersed in the water, as results when it is the sole support, the individual paddles enter and leave the water at a corresponding large angle. As a consequence, the paddle moves the water downward and rearward while entering the water and upward and rearward when leaving the water. Since only the movement of water which is rearward versus the direction of movement actually propels the swimmer, all additional energy spent in moving the water vertically is wasted and since water is a very dense medium this wasted energy is considerable.

My invention avoids these problems by permitting a swimming motion which closely mimics the normal arm motions of a swimmer to aid in more rapid learning. Only one blade is used for each paddle rather than a paddle wheel which greatly reduces storage and transportation problems. Only one blade is rotated at a time similar to an oar engaging the water while the blade motion is horizontal which eliminates waste energy in moving the water vertically and which mimics a normal swimming stroke.

SUMMARY OF THE PRESENT INVENTION

The present invention provides a manually powered pair of flat paddles which are interconnected by a crank which offsets sized to be rotated and driven by the arms of a swimmer. Two handles which are free to rotate with respect to the crank permits the swimmer to grasp the crank and exert a great deal of force with little rotation friction. Each paddle is essentially flat and is affixed to opposite ends of the crank.

The paddles are formed from a foamed plastic which solidifies into a solid with a great number of entrapped air bubbles to provide flotation. If desired, the paddles can be enclosed by a matching plastic skin to provide protection for the foamed plastic. The paddles are each formed about a pair of metal plates and have a central semicircular channel sized such that when the plates are placed opposing each other the resulting circular channel will fit about the end of the crank.

A disk shaped mechanism on each end of the crank is attached to a perpendicular extension on these metal plates. The disk shaped mechanism is arranged to encircle the crank ends when the paddles are mounted in place. A driver portion of this mechanism is keyed to the crank while a follower portion is attached to the perpendicular extensions from each of the plates. A wobble plate mounted adjacent to the plate extensions permits the driver to be vertically displaced to intermittently engage the follower by allowing a projecting cam on the driver to engage a spur on the follower when the cam is at a certain angular relationship with respect to the follower. A cover plate is secured over the mechanism and end of the crank for protection. When the driver is advanced approximately 180 degrees the follower portion of the mechanism is no longer driven to provide intermittent motion.

In use, the swimmer thrusts downward and backward with one arm and upward and forward with the other arm. The downward thrusting arm will rotate the crank and also bear downward on that side. The wobble plate is arranged to permit the end of the crank to shift to always be on the down side relative to the remainder of the mechanism. The drivers are arranged 180° out of phase such that one of the projections on the drives on the downward crank will engage the follower while the projections on the driver of the opposite end will be disengaged. When the driver engages the follower the crank will rotate the follower and the paddle on that end while the paddle on the opposite end will be disengaged and will lie flat on the water. The result will be that one paddle only will engage with the water and provide a propulsive force while the opposite paddle will lie flat and provide support only. There is little vertical movement in this stroke and consequently little wasted energy.

When the swimmer reaches the end of this stroke where the driven paddle has rotated 180 degrees and is lying flat in the water with the drivers both rotated 180° the engagement will reverse ends and will permit the driver on the opposite end to engage the follower to repeat the stroke on the opposite side while the first end driver will be disconnected.

While some rotation motion of the swimmer's arms is still necessary to operate this device an alternate rowing motion of the arms is also required which much more closely approximates the normal use of the arms in swimming. The water is driven horizontally which makes this device very efficient.

DESCRIPTION OF THE PREFERRED EMBODIMENT

Figure 1:
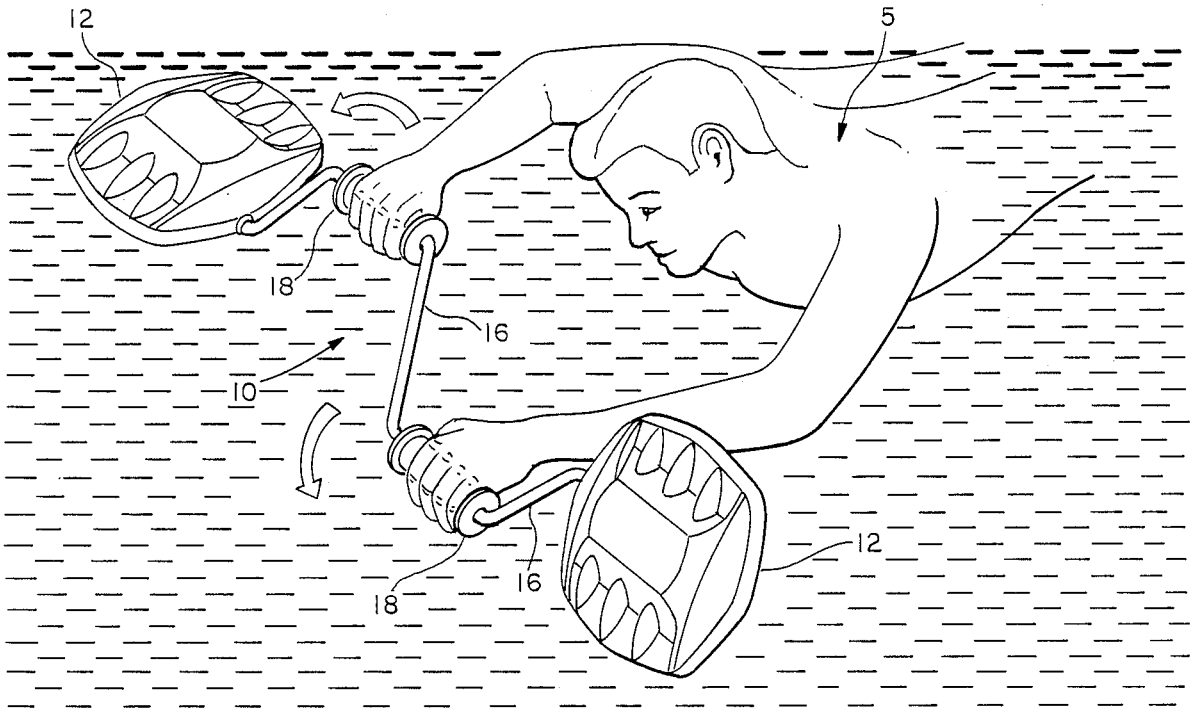
FIG. 1 is a perspective view of the apparatus in use.
Figure 2:
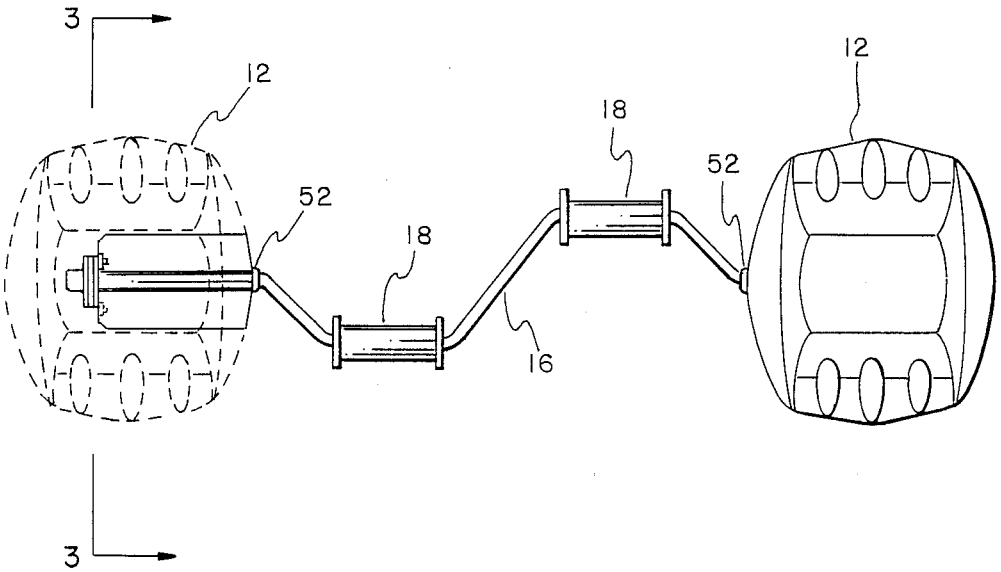
FIG. 2 is a top view of the apparatus with the left paddle in phantom outline.

Referring now to the drawings FIGS. 1–9 illustrate a preferred embodiment of this apparatus. FIG. 1 illustrates a swimmer 5 using swimming device 10 in the water. In this figure swimmer 5 is thrusting forward with his right hand and pulling with his left hand to rotate the device in the direction indicated by the arrows. Paddles 12 are mounted on opposite ends of crank 16 but here only the left paddle relative to the starter is being rotated while the right paddle rests flat in the water.

Crank 16 has two free turning handles 18 to permit swimmer 5 to turn the crank freely. Handles 18 are limited in their horizontal movement along crank 16 by the offsets adjacent to the handles of the crank which can be seen more clearly in FIG. 2.

Here leftmost paddle 12 is shown in phantom outline with the inner structure revealed. The outer structure of paddle 12 is formed from plastic liquids which are foamed and set into a solid and which is formed by a mold into the shape illustrated.

Figure 3:
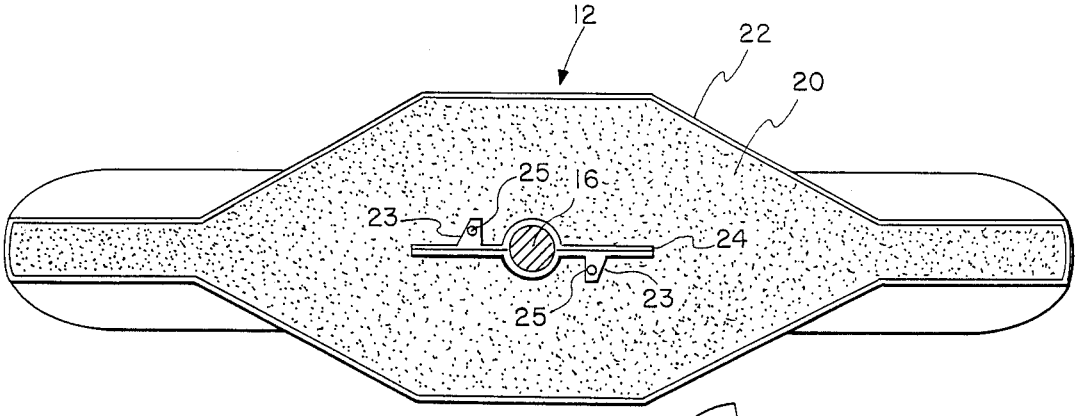
FIG. 3 is a cross-section 3—3 of FIG. 2.

In FIG. 3 the cross-sectional end view of the interior of paddle 12 can be seen. A plastic skin 22 which covers and protects foam 20 is secured in place after the foam is set by gluing two plastic skin halves together each having the same interior shape as the exterior of the foam. Two generally flat metal plates 24 each have a semi-circular center section to enclose crank 16. Each plate 24 has an integral peripheral projection 23 at the outside edge to engage the remainder of the mechanism using holes 25 as will be described later.

Figure 6:
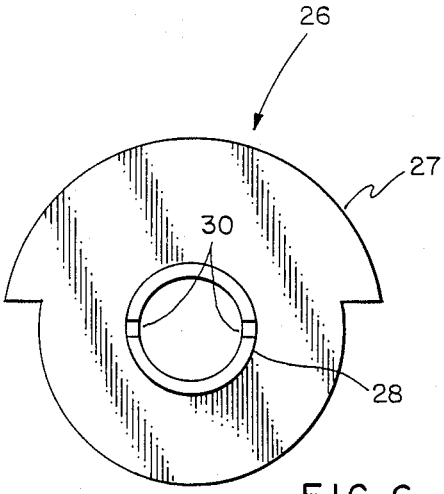
FIG. 6 is a plane view of a driver.

In FIGS. 6, 7, 9, and 10 parts of mechanism 14 are shown. FIG. 6 is a plane view of a driver 26 with a projecting cam 27 which is used to alternately couple power from crank 16 to paddle 12. A vertical integral cylinder 28 extending from driver 26 is sized to fit about the end of crank 16. A pair of aligned holes 30 perpendicular to cylinder 28 are sized to receive a pin, not shown, which is used to key driver 26 to crank 16.

Figure 7:
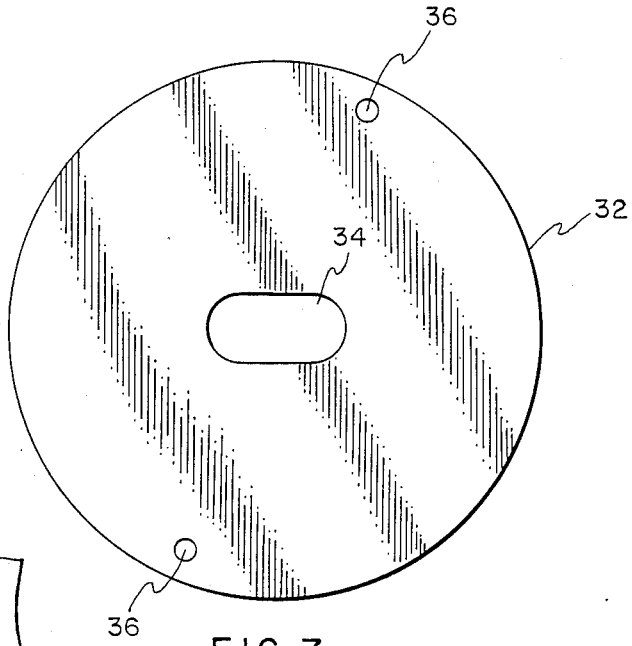
FIG. 7 is a plane view of a wobble plate.
Figure 9:
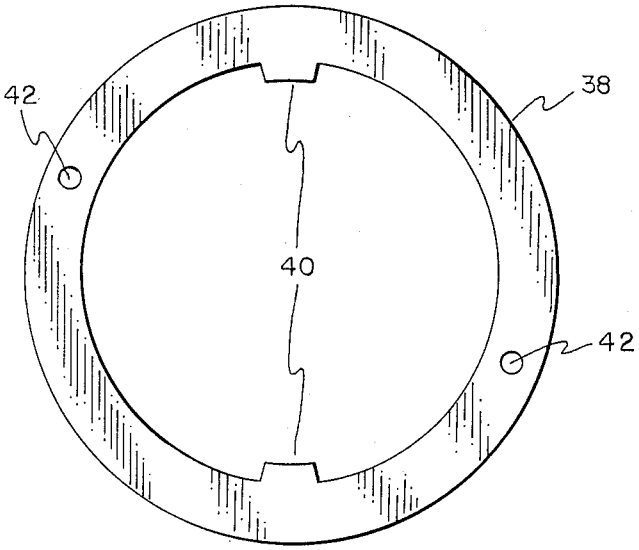
FIG. 9 is a plane view of a follower.
Figure 10:
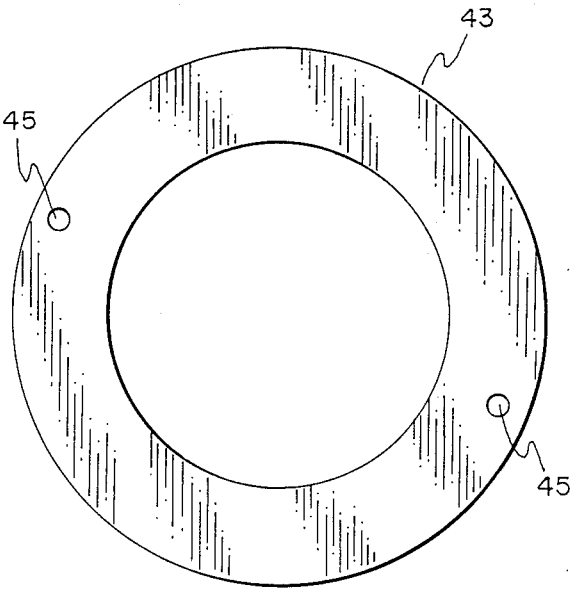
FIG. 10 is a plane view of a spacer washer.

In FIG. 7 wobble plate 32 is shown which has an elongated center hole 34 and two mounting holes 36. In FIG. 9 follower 38 is shown having two opposing inwardly directed spurs 40 and mounting holes 42 which are the same size and spacing as mounting holes 36 in FIG. 7. In FIG. 10 a washer 43 with mounting holes 45 is shown.

Figure 8:
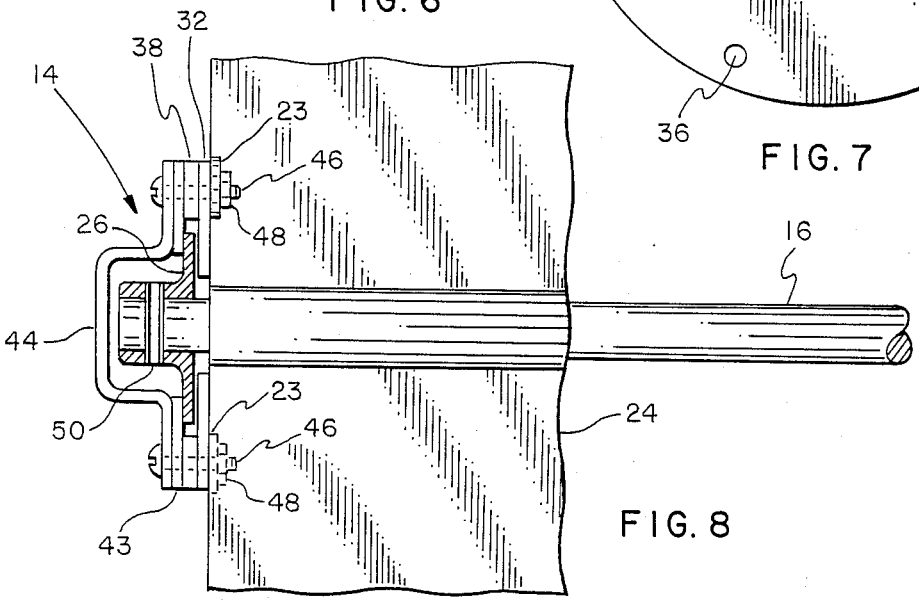
FIG. 8 is a cross-section side view of the mechanism and a portion of adjacent parts.

In FIG. 8 mechanism 14 is shown mounted on one end of crank 16. The opposite end of crank 16 has the same mechanism 14 mounted as here but with the drive mechanism 180° out of phase with respect to the crank. A metal cover plate 44 is secured over the end of crank 16 which has a stamped cupped center to accomodate the projecting end of the crank. Cover plate 44 encloses the operating parts of mechanism 14 to keep foam plastic liquids out during manufacture and to keep lubricant in during use. Two mounting holes through cover plate 44 are of the same size and spacing as mounting holes 36 in wobble plate 32, shown in FIG. 7.

Mechanism 14 is assembled with cover plate 44 leftmost then washer 43 then follower plate 38 encircling driver 26 then wobble plate 32 with all parts mounted around the end of crank 16. Bolts 46 through the mounting holes in cover plate 44, mounting holes 45 in washer 43, mounting holes 42 in follower plate 48, mounting holes 36 in wobble plate 32 and holes 25 in projections 23 extending from plates 24 are all secured by nuts 48 to hold mechanism 14 together and attach it to plates 24. A key 50 through holes 30 in cylinder 28 and a matching aligned hole in crank 16 keys driver 26 to the crank. Washer 43 keeps the edges of driver 26 aligned with follower plate 38. A sleeve bearing 52 mounted around crank 16 minimizes friction, shown in FIG. 4.

Figure 4:
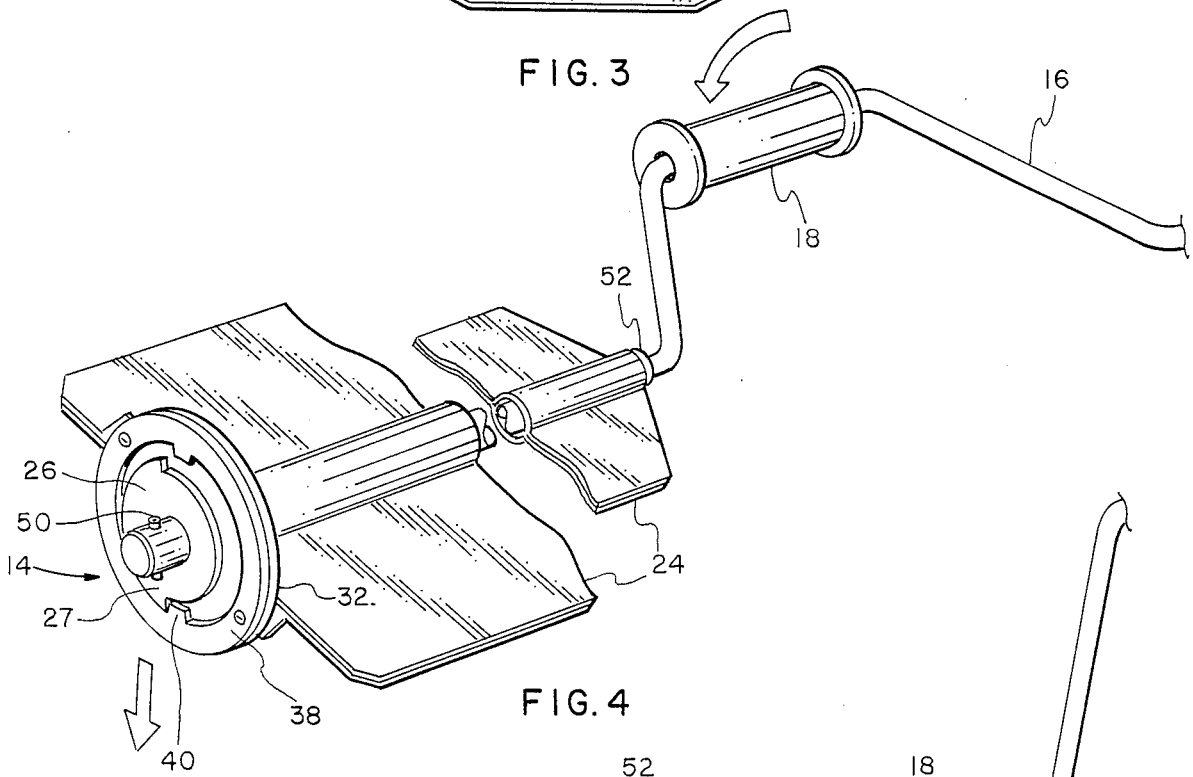
FIG. 4 is a perspective view of a portion of the mechanism enlarged with the mechanism engaged.
Figure 5:
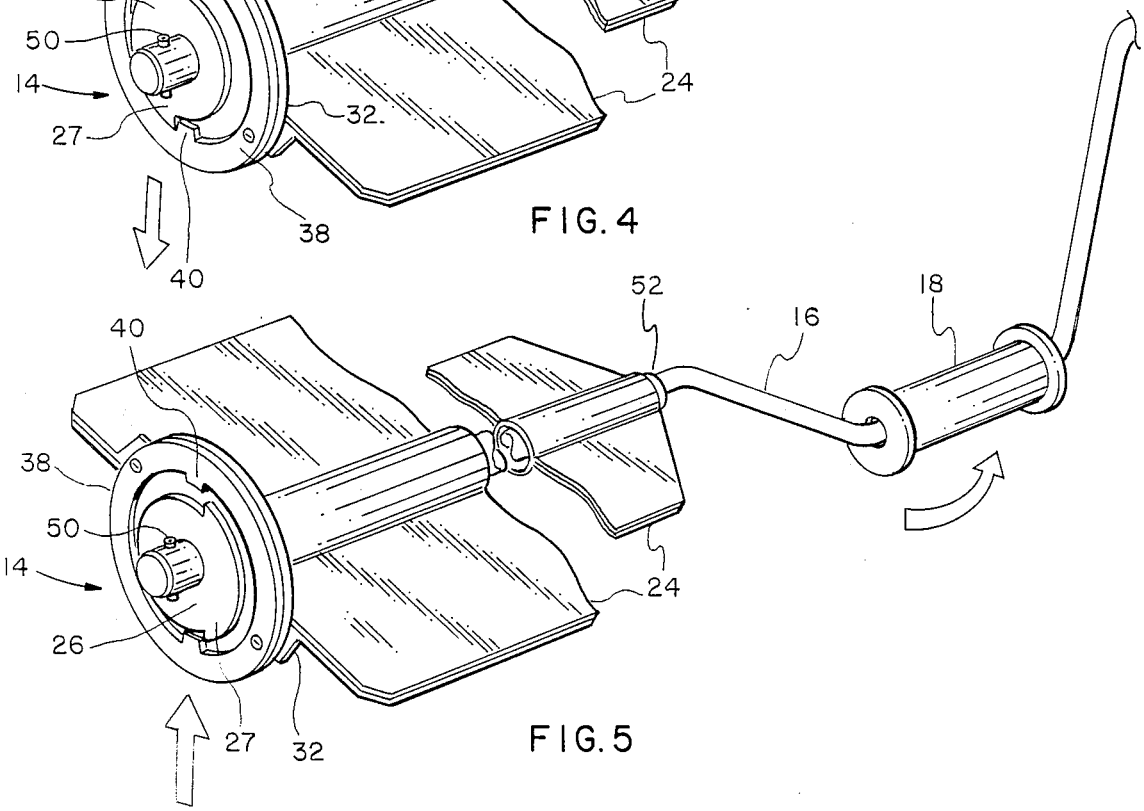
FIG. 5 is the view of FIG. 4 with the mechanism disengaged.

In FIGS. 4 and 5 the operation of the various parts of mechanism 14 is shown. In FIG. 4 crank 16 is being rotated counterclockwise as viewed from the left end and handle 18 is horizontal in the stroke and being forced downward. In this view cover plate 44 and washer 43 are omitted to give a better view of the remainder of mechanism 14. At this part of the cycle elongated center hole 34 in wobble plate 32, not shown, is oriented with the long dimension vertical which permits the end of crank 16 to move downward with respect to plates 24. This occurs because plates 24 are supported by paddle 12, not shown in this figure, being supported by water. This relative vertical motion permits cam 27 to engage spur 40 on the bottom of follower 38 which will cause plates 24 and associated paddle 12 to rotate. At the same time the opposite end of crank 16 is in the relationship with hole 34 in wobble plate 32 also oriented with the long dimension vertical but since driver 26 is keyed 180 degrees out of phase the driver will be disconnected from the follower, as will be explained later.

Whereas before in FIG. 4 the lower edge of cam 27 was aligned with spur 40, which caused follower 38 to be rotated by driver 26, now 180 degrees later, as shown in FIG. 5, with crank 16 again at the lower position cam 27 will clear upper spur 40 allowing free rotation of crank 16 in the direction shown. This will decouple shaft 16 from plate 24 and from the enclosing paddle 12. In the position between FIGS. 4 and 5 when the paddle 12 enclosing plate 24 passes beyond the point where the flat paddle is perpendicular to the water the buoyancy of the paddle will tend to rotate the paddle to the attitude shown in FIG. 5 where it will remain until driver 26 again reengages follower 38 as described earlier.

This mechanism will operate in the same way regardless of the direction of rotation in that one paddle will be driven and the other paddle free for essentially one half a revolution and then the driven and free paddles will be reversed.

Mechanism 14 thus provides a means for coupling and decoupling paddles 12 from crank 16 with each paddle alternately providing propulsion or support only. Device 10 will work with either paddle oriented on the swimmer's left or right side. There is no orientation restriction in that device 10 can merely be thrown into the water and the swimmer 5 can grasp either side and the operation will be the same.

The mechanical parts can be stamped from a number of metals or plastics and the formed center of paddles 12 can use any number of plastics well known in the art which will foam and entrap air and then solidify. This swimming aid is easy to manufacture, simple in construction and easy to store and transport. Its use will both support the beginning swimmer in the water, permit him to use his legs normally and permit him to mimic an arm swimming stroke.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. Swimming apparatus comprising:

(a) a pair of generally flat paddles having a density less than that of water, and (b) an intermediate shaft connecting said paddles together said shaft having opposed crank arms, and (c) a pair of mechanisms attaching said shaft to said paddles said mechanisms having engagement means such that one paddle will be connected to said shaft for approximately one half of a shaft revolution while the opposite paddle is disconnected with the connections reversed for the remaining half of a shaft revolution.

2. Apparatus as in claim 1 and further comprising protective covers for said paddles having an inner shape essentially the same as the outer shape of said paddles.

3. Apparatus as in claim 1 and further comprising a pair of handles enclosing said shaft at said crank locations said handles being free to turn with respect to said shaft.

4. Apparatus as in claim 3 and further comprising a pair of sleeve bearings interposed between said handles and said shaft to reduce friction.

5. The apparatus as in claim 1 whereby said paddles are each formed from foamed plastic over a generally flat metal plate said plate having a central opening in the plane of said pate of a size to enclose said shaft and said plate having a pair of opposed perpendicular projections from one edge which are perpendicular to said central opening for the attachment of one of said mechanisms.

6. Apparatus as in claim 1 whereby each said mechanism comprises (a) a wobble plate having an elongated center hole said elongated hole encircling said shaft and dimensioned such that said shaft can be displaced to the extremes of said elongated hole, each said wobble plate being attached to the end of a paddle, and (b) a driver encircling and keyed to said shaft said driver having one projecting cam tooth extending outwardly for less than one hundred and eighty degrees; and (c) a follower encircling said driver with two equal sized opposed inwardly directed spurs said follower being attached to said wobble plate with said driver cam and said follower spurs dimensioned such that, when said shaft is at a first extreme end of said elongated hole in said wobble plate, said cam will engage the spur adjacent to said first extreme end of said elongated hole when said shaft is rotated in a first direction relative to said follower but said cam will not engage said adjacent spur when said shaft is rotated in the opposite direction, and alternately when said shaft is at the second extreme end of said elongated hole in said wobble plate, said cam will not engage the spur adjacent to said second extreme end of said elongated hole when said shaft is rotated in said first direction relative to said follower but said cam will engage said adjacent spur when said shaft is rotated in the opposite direction, and (d) a spacer washer encircling said shaft adjacent to and dimensioned to extend inward beyond said driver and outward beyond said follower to maintain alignment between the edges of said driver and said follower said spacer washer attached to said driver plate, and (d) said mechanisms having said drivers aligned out of phase with each other such that the sequence of the engagement and disengagement of said respective adjacent spurs by said respective cams are reversed in sequence from one mechanism to the other.

7. The mechanism as in claim 6 whereby each said mechanism further comprises a circular shaped cover plate having a generally cup shaped central depression said cover plate attached to said spacer washer with said cup covering an end of said shaft and with said cup dimensioned so as not to interfere with the displacement of said shaft end to the extreme ends of said wobble plate.

* * * * *